US005152015A

United States Patent [19]

Fourman

[11] Patent Number: 5,152,015

[45] Date of Patent: Oct. 6, 1992

[54] ADDITIVE PRODUCT DISPENSING APPARATUS

[75] Inventor: Robert Fourman, Bordentown, N.J.

[73] Assignee: Reckitt & Colman Inc., Wayne, N.J.

[21] Appl. No.: 725,759

[22] Filed: Jul. 3, 1991

[51] Int. Cl.[5] ..... E03D 9/02

[52] U.S. Cl. ..... 4/225.1; 4/227.4

[58] Field of Search ..... 4/225, 227, 228, 223; 222/68, 88, 67, 428, 442; 137/205.5

[56] References Cited

U.S. PATENT DOCUMENTS

| | | | |
|---|---|---|---|
| 2,553,817 | 5/1951 | Erland Af Kleen | 222/383 X |
| 2,832,366 | 4/1958 | Farison | 137/205.5 X |
| 3,229,854 | 1/1966 | Turnquist | 222/67 |
| 3,306,504 | 2/1967 | Tischler | 222/442 |
| 3,459,332 | 8/1969 | Golden | 222/68 X |
| 3,778,849 | 12/1973 | Foley | 4/228 |
| 3,890,657 | 6/1975 | Gray | 4/228 X |
| 4,064,572 | 12/1977 | Wicks, III et al. | 4/227 |
| 4,312,082 | 1/1982 | Murphy et al. | 4/228 |
| 4,507,811 | 4/1985 | Buelow et al. | 4/225 |
| 5,027,444 | 7/1991 | Tsals | 4/225 |

FOREIGN PATENT DOCUMENTS

| | | | |
|---|---|---|---|
| 3019 | of 1909 | United Kingdom | 4/225 |

*Primary Examiner*—Henry J. Recla
*Assistant Examiner*—Robert M. Fetsuga
*Attorney, Agent, or Firm*—Frederick H. Rabin

[57] ABSTRACT

An additive product dispensing apparatus for a toilet tank which prevents waste of excessive chemicals within the toilet tank and causes the treatment solution to remain in the toilet bowl water after the flushing cycle. The dispensing apparatus includes a product chamber for receiving the additive product. The product chamber communicates with an overflow pipe of the toilet tank by way of a conduit assembly having three ball check valves associated therewith. The check valves allow dispensing of a specific dosage of the product and are responsive to the rise and fall of water in the tank.

9 Claims, 9 Drawing Sheets

ADDITIVE PRODUCT DISPENSING APPARATUS

This invention relates to an additive product dispensing apparatus for a toilet tank. The additive product preferably is any suitable product which is a liquid when in use in the toilet tank. Any suitable liquid toilet bowl treatment product could be utilized.

Prior such additive product dispensing apparatus have been subject to the disadvantages that excessive chemicals have been wasted within the toilet tank and all the treatment solutions have not remained in the toilet bowl water after the flushing cycle.

It is an object of the present invention to provide a new and improved additive product dispensing apparatus for a toilet tank which avoids one or more of the disadvantages of prior such apparatus.

In accordance with the invention, an additive product dispensing apparatus for a toilet tank having an overflow pipe comprises a product chamber within a toilet tank, the toilet tank containing water having a water level. The apparatus includes an accumulator chamber having a conduit communicating with the toilet tank. The accumulator chamber has a first high/-low pressure gate controlling communication between the accumulator chamber and the toilet tank. The accumulator chamber also has a second high-low pressure gate. The apparatus also includes a product inductor conduit communicating with the product chamber and through the second high/low pressure gate with the accumulator chamber. The apparatus also includes product discharge means, communicating with the accumulator chamber and having a product discharge high/low pressure gate, for controlling product discharge. The apparatus also includes a product discharge conduit communicating with the accumulator chamber through the product discharge means and extending from the accumulator chamber to the toilet tank overflow pipe.

For a better understanding of the invention, together with other and further objects thereof, reference is made to the following description, taken in connection with the accompanying drawings, and its scope will be pointed out in the appended claims.

Referring now to the drawings.

Figure 1:
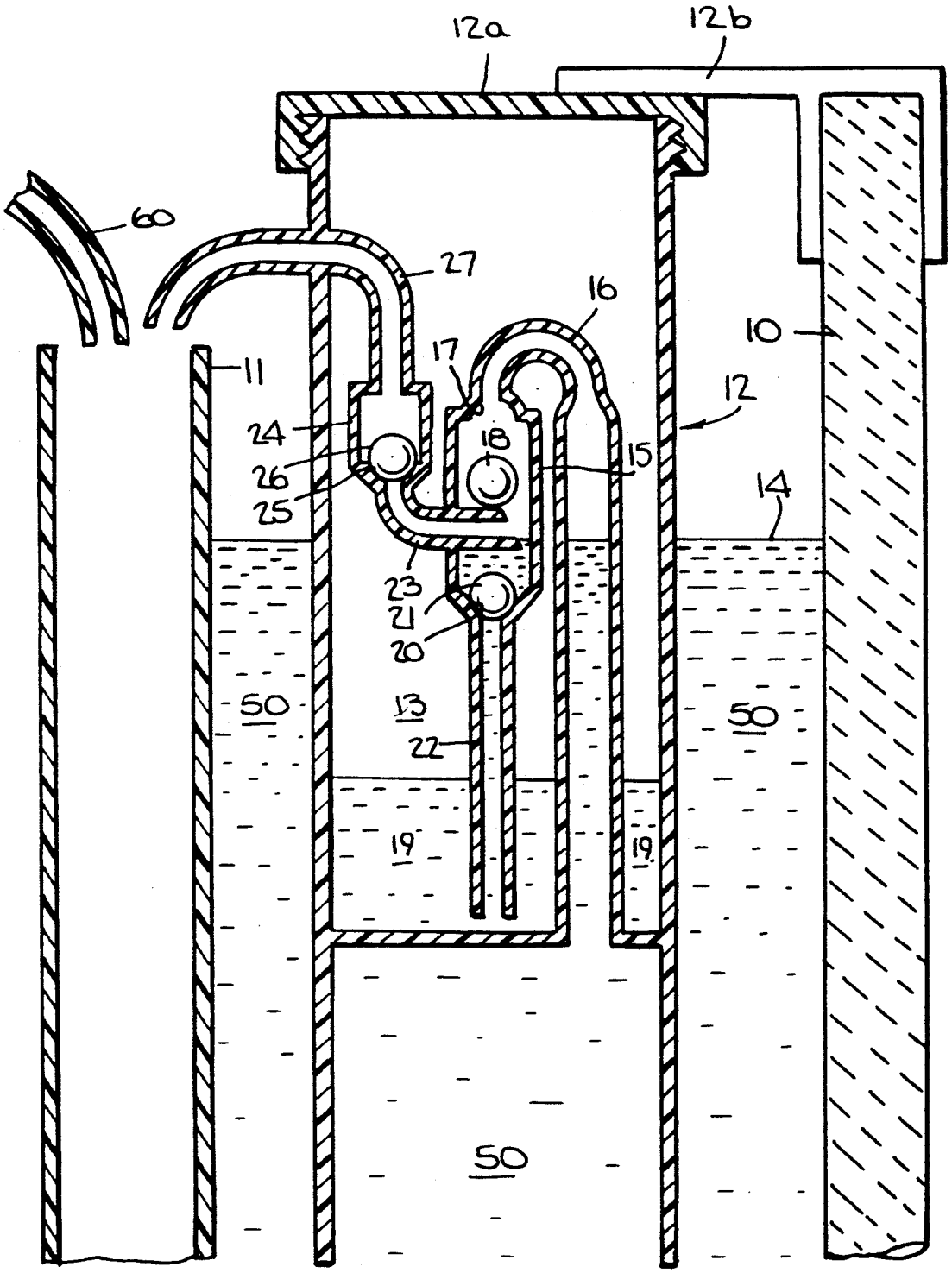
FIG. 1 is a sectional view of a portion of a toilet tank having dispensing apparatus in accordance with the invention suspended therein.

Referring now more particularly to FIG. 1 of the drawings, a toilet tank 10 is there represented in fragmentary sectional view with an overflow pipe 11. An additive product dispensing apparatus 12 in accordance with the invention comprises a product chamber 13 within the toilet tank. The toilet tank contains water 50 having a water level 14. The dispensing apparatus includes an accumulator chamber 15 having a conduit 16 communicating with the toilet tank 10. The accumulator chamber 15 has a high/low pressure gate in the form of a ball seat 17 for receiving a ball check 18. The high/-low pressure ball check 18 has a specific gravity less than the specific gravity of the product 19.

The accumulator chamber 15 also has a second high/-low pressure gate in the form of a ball seat 20 for receiving a second ball check 21. The second ball check 2 has a specific gravity greater than the specific gravity of the product 19.

The dispensing apparatus also includes a product inductor conduit 22 communicating with the accumulator chamber and the product chamber 13. The apparatus also includes product discharge means having a first product discharge conduit 23 communicating with the accumulator chamber 15 and a product discharge chamber 24 which communicates with the first product discharge conduit 23 and has a high/low pressure gate in the form of a discharge ball seat 25 for receiving a product discharge ball check 26. The product discharge ball check has a specific gravity greater than the specific gravity of the product 19.

The apparatus also includes a second product discharge conduit 27 communicating with the discharge chamber 24 and extending from the discharge chamber 24 to the toilet tank overflow pipe 11.

FIG. 1 represents the toilet tank 10 and the dispensing apparatus 12 in a rest condition when the toilet tank water level 14 is at its normal maximum level and with the dispensing apparatus 12 generally enclosed by a closure 12*a* and attached to the toilet tank by a suitable bracket 12*b*. Upon insertion of the dispensing apparatus 12 into the toilet tank water 50, the apparatus 12 allows the entrapped air to be evacuated through the conduit 16 into the accumulator chamber 15, exiting through the discharge conduit 23, causing the lifting of the discharge ball check 26 from the seat 25 and allowing the trapped air to exit the discharge tube 27.

Figure 2:
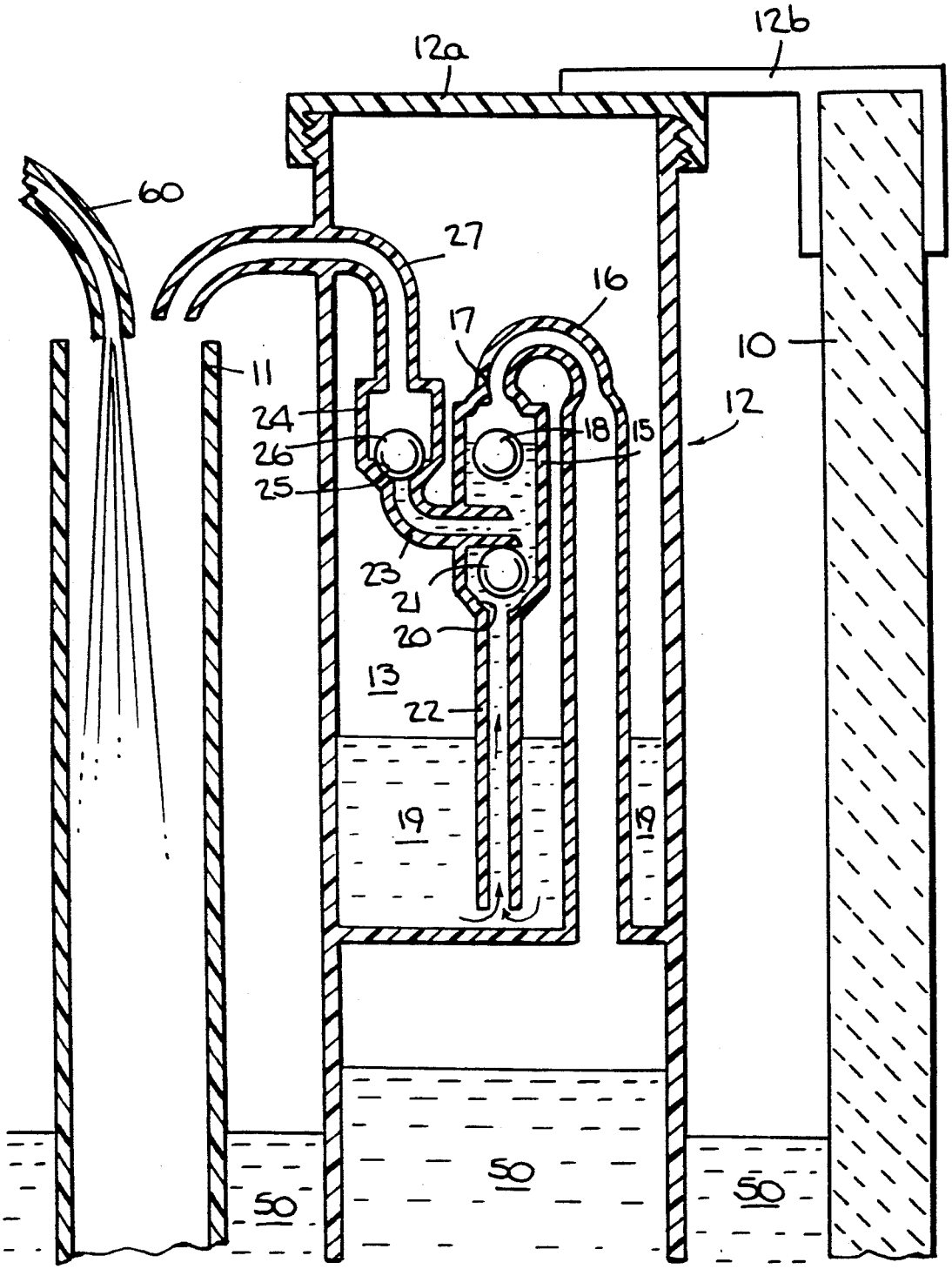
FIG. 2 is a sectional view showing the dispensing apparatus in the induction stage during the falling of the water level in the toilet tank during the flush cycle.
Figure 3:
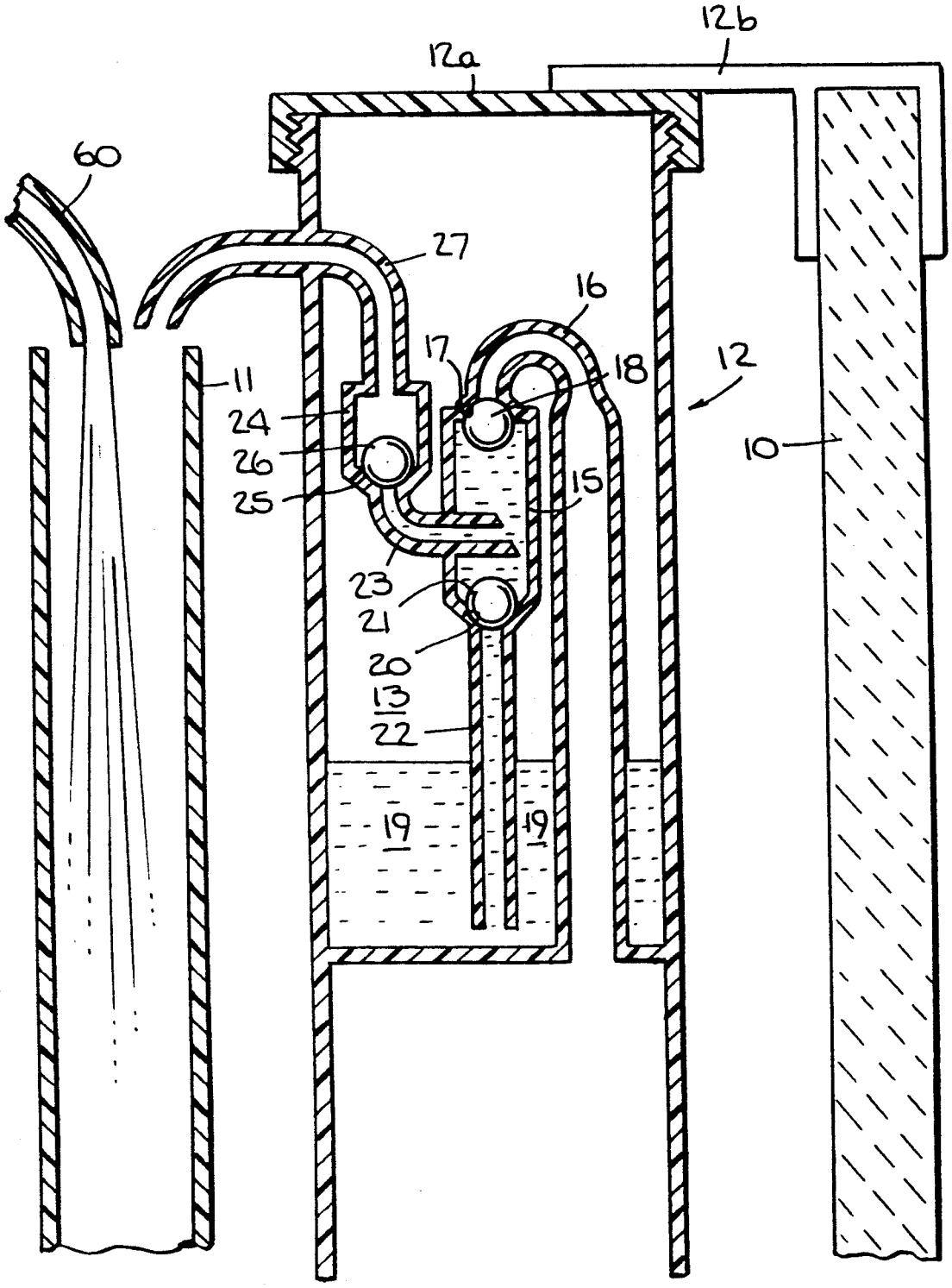
FIG. 3 is a sectional view showing the dispensing apparatus in the primed stage prior to the rising of the water during the flush cycle.

Referring now to FIG. 2, when the toilet tank water level falls during flushing, the water level in the conduit 16 communicating with the toilet tank falls, causing a reduced pressure in the accumulator chamber 15 and a rising of the product 19 in the inductor conduit 22. Accordingly, a syphoning effect takes place which transmits a low pressure to the accumulator chamber 15. This causes a displacement of the second ball check 21 from the second ball seat 20 to fill the accumulator chamber 15 and seats the high/low pressure first ball check 18 in the high/low pressure first ball seat 17, as represented in FIG. 3. This prevents the product 19 from being syphoned into the conduit 16 and meters a predetermined amount of the product 19 to be dispersed.

As also represented in FIG. 3, when the toilet tank is emptied during flushing, the three ball checks are seated in their respective ball seats.

Figure 4:
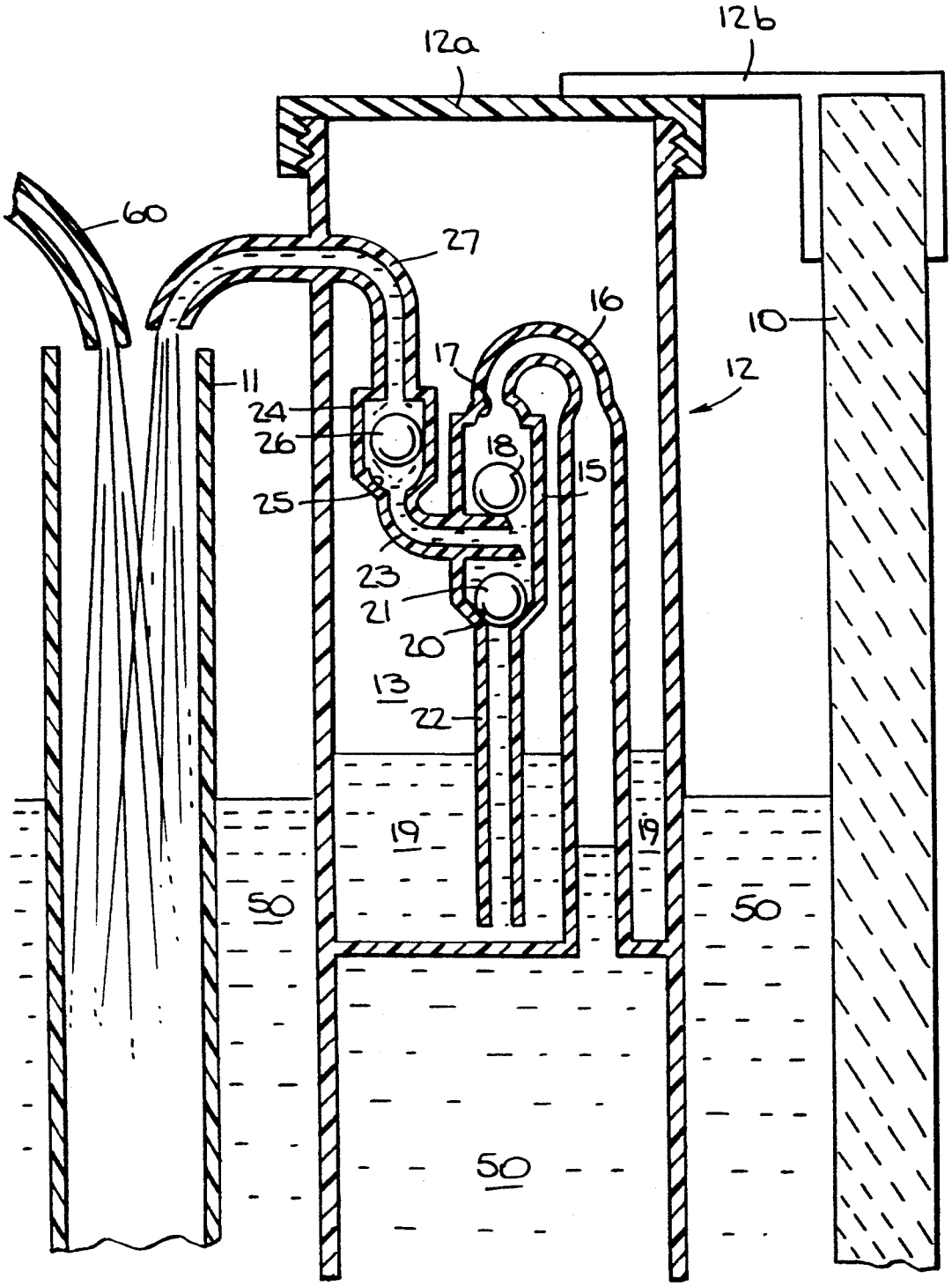
FIG. 4 is a sectional view showing the dispensing apparatus in the discharge stage during the rise of the water in the toilet tank during the flush cycle.

Referring now to FIG. 4, when the toilet tank fills, the water rises in the toilet tank, compressing the air in the conduit 16 communicating with the toilet tank, forcing the high/low pressure ball check 18 to open and forcing the product to be discharged from the accumulator 15 through the first product discharge conduit 23, forcing the discharge ball check 26 to be unseated. The discharge chamber 24 thereby communicates with the second product discharge conduit 27 and the additive product is discharged into the toilet tank overflow pipe. The product is washed down the overflow pipe in the toilet tank by water from the bowl refill tube 60.

The conduit 16 preferably extends approximately to the top of the apparatus 12 and communicates by way of the check valve seat 17 with the upper chamber of the accumulator 15. The discharge conduit 23 serves as a volume control discharge tube. The amount of the product 19 discharged within the accumulator chamber 15 is determined by the height of the discharge conduit 23 within the accumulator chamber 15. Upon total exhaustion of the product between the high/low pressure seat 17 and the volume discharge tube 23, the system reaches equilibrium and returns to the static condition represented in FIG. 1.

Figure 5:
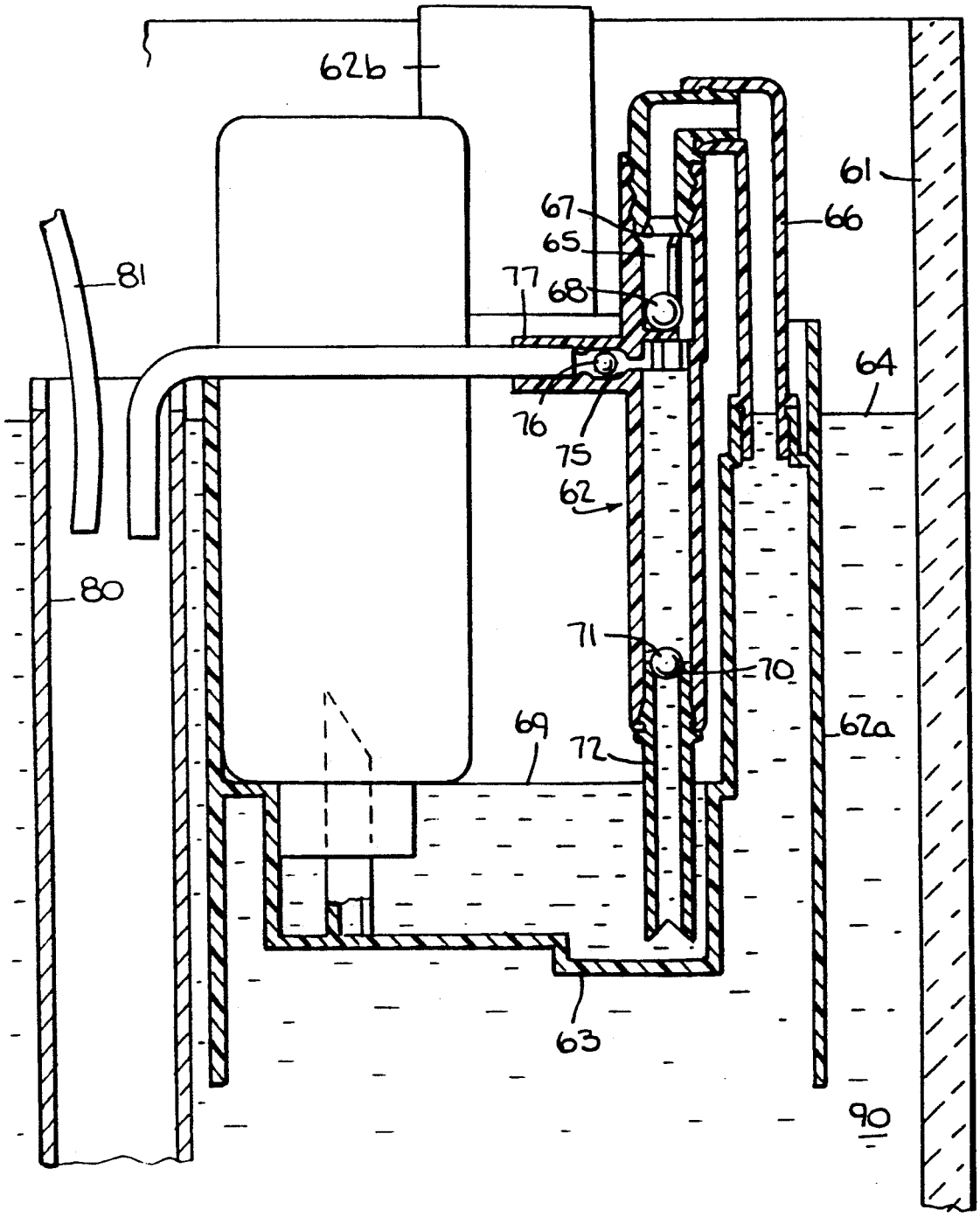
FIG. 5 is a sectional view of a portion of a toilet tank having another embodiment of dispensing apparatus in accordance with the invention suspended therein.

Referring now more particularly to FIG. 5 of the drawings, a toilet tank 61 is there represented in fragmentary sectional view with an overflow pipe 80. An additive product dispensing apparatus 62 in accordance with the invention comprises a product chamber 63 within the toilet tank. The toilet tank contains water 90 having a water level 64. The dispensing apparatus 62 includes an accumulator chamber 65 having a conduit 66 communicating with the toilet tank 61. The accumulator chamber has a first high/low pressure gate 67, 68 controlling communication between the accumulator chamber 65 and the toilet tank 61.

The accumulator chamber 65 also has a second high/low pressure gate 70, 71. A product inductor conduit 72 communicates with the product chamber 63 and through the second high/low pressure gate 70, 71 with the accumulator chamber 65.

The dispensing apparatus also includes product discharge means communicating with the accumulator chamber 65 and having a product discharge high/low pressure gate in the form of a discharge ball seat 75 for receiving a product discharge ball check 76 for controlling the product discharge. The dispensing apparatus also includes a product discharge conduit 77 communicating with the accumulator chamber through the product discharge means and extending from the accumulator chamber to the tank overflow pipe.

Figure 6:
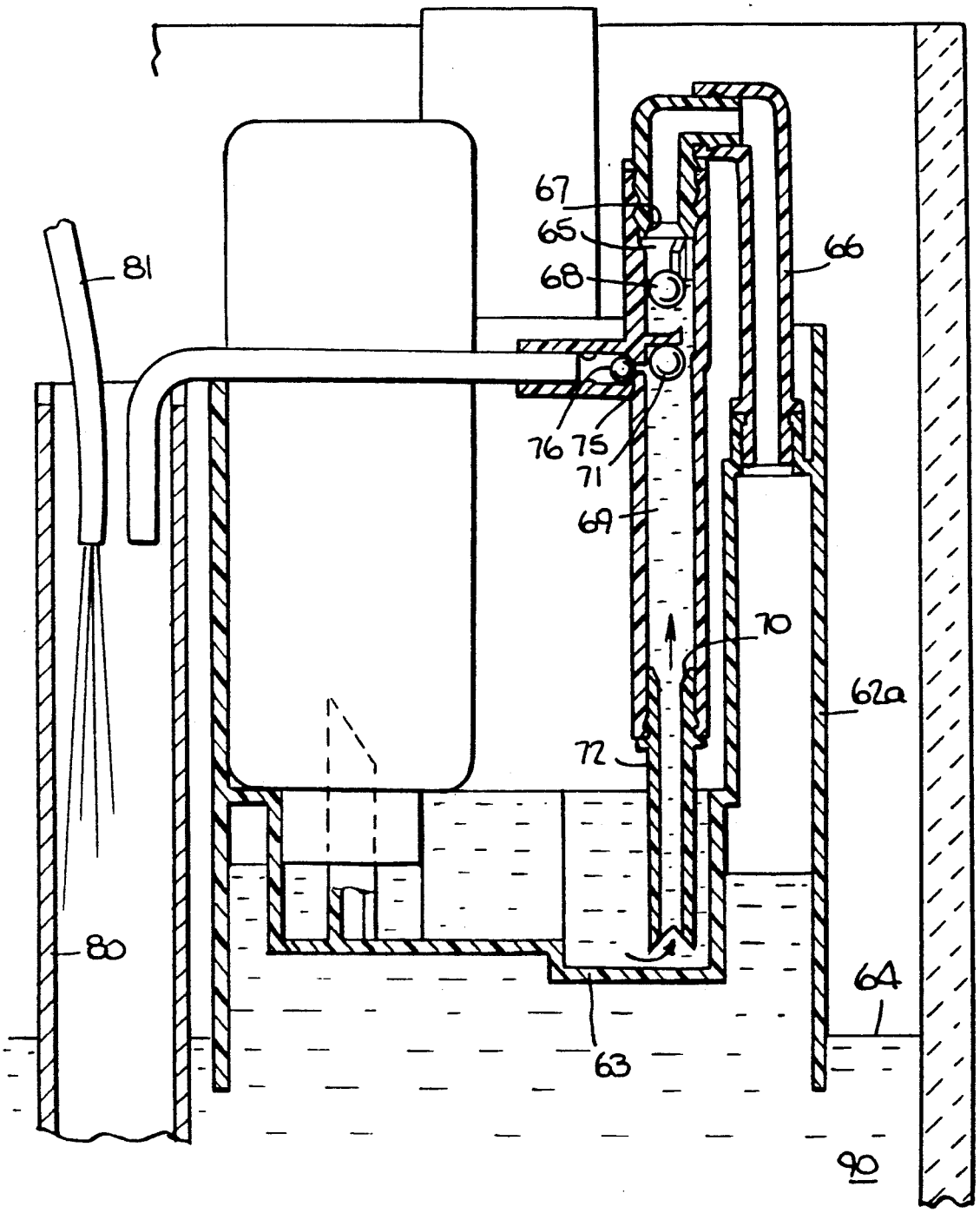
FIG. 6 is a sectional view showing the FIG. 5 dispensing apparatus in the induction stage during the falling of the water level in the toilet tank during the flush cycle.

Referring now to FIG. 6, when the toilet tank water level falls during flushing, the water level in the conduit 66 communicating with the toilet tank 61 falls, causing a reduced pressure in the accumulator chamber 65 and a rising of the product 69 in the inductor conduit 72. The discharge ball seat 75 receives the product discharge ball check 76 due to the reduced pressure in the accumulator chamber 65. The product discharge ball check 76 may have a specific gravity greater than, equal to or less than the specific gravity of the product 69.

FIG. 5 represents the toilet tank 61 and the dispensing apparatus 62 in a rest condition when the toilet tank water level 64 is at its normal maximum level and with the dispensing apparatus 62 generally enclosed by a closure wall 62*a* and attached to the toilet tank by a suitable bracket 62*b*. Upon insertion of the dispensing apparatus 62 into the toilet tank water 90, the apparatus 62 allows the entrapped air to be evacuated through the conduit 66 into the accumulator chamber 65, exiting through the discharge conduit 77 while causing the separation of the discharge ball check 76 from the seat 75 and allowing the trapped air to exit the discharge conduit 77.

Figure 7:
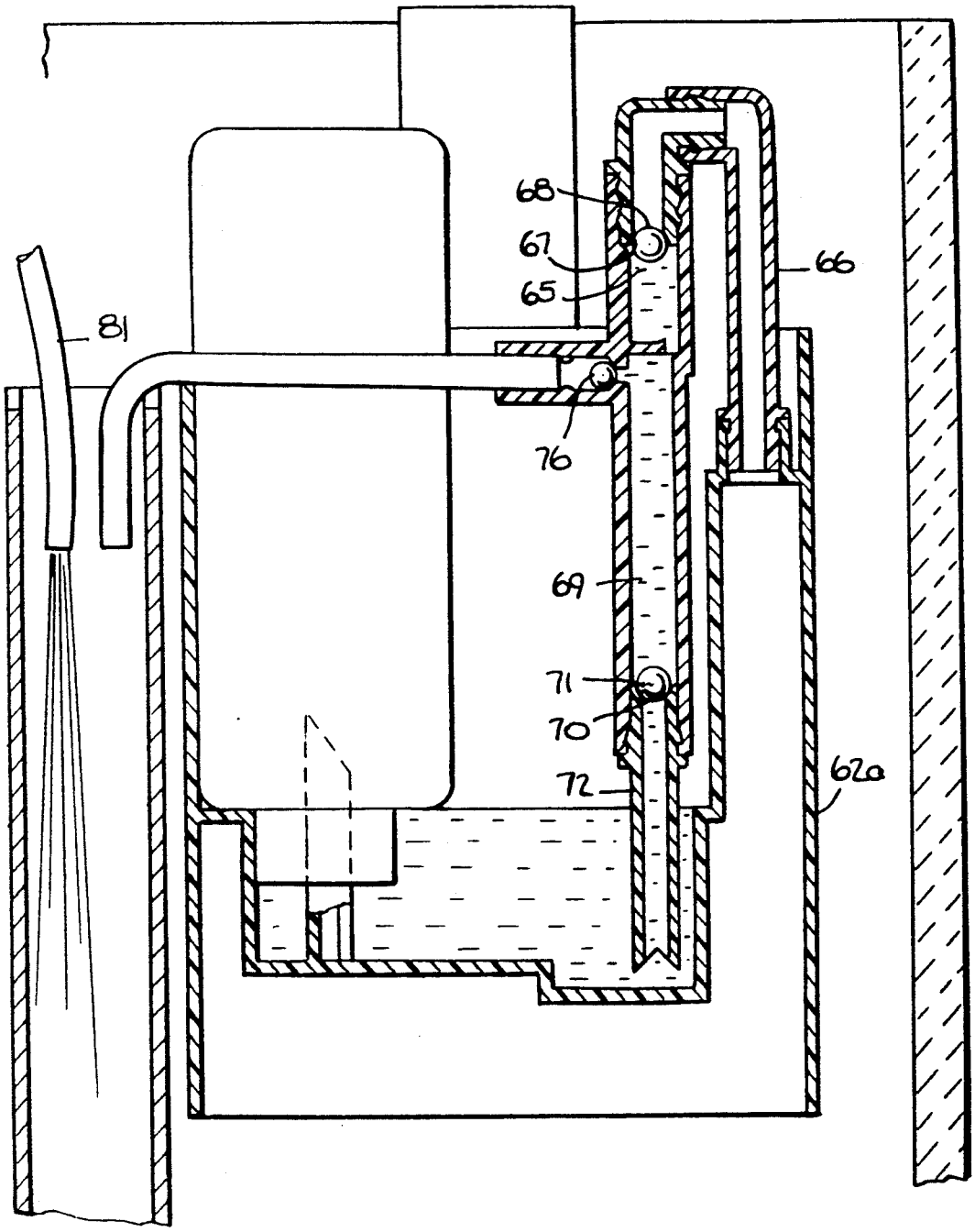
FIG. 7 is a sectional view showing the FIG. 5 dispensing apparatus in the primed stage prior to the rising of the water during the flush cycle.

Referring now to FIG. 6, when the toilet tank water level falls during flushing, the water level in the conduit 66 communicating with the toilet tank falls, causing a reduced pressure in the accumulator chamber 65 and a rising of the product 69 in the inductor conduit 72. Accordingly, a siphoning takes place which transmits a low pressure to the accumulator chamber 65. This causes a displacement of the ball check 71 from the ball seat 70 to fill the accumulator chamber 65 and seats the high/low pressure first ball check 68 in the high/low pressure first ball seat 67, as represented in FIG. 7. This prevents the product 69 from being siphoned into the conduit 66 and meters a predetermined amount of the product 69 to be dispensed. During this phase of operation the discharge ball check 76 is seated in the seat 75 because of the low pressure transmitted in the inductor conduit 72.

The first ball check 68 preferably has a specific gravity less than the specific gravity of the product 69. The second ball check 71 preferably has a specific gravity greater than the specific gravity of the product 69. The ball checks 68, 76, and 71 respond to the pressure of the flow of the product in the inductor tube 70.

Figure 8:
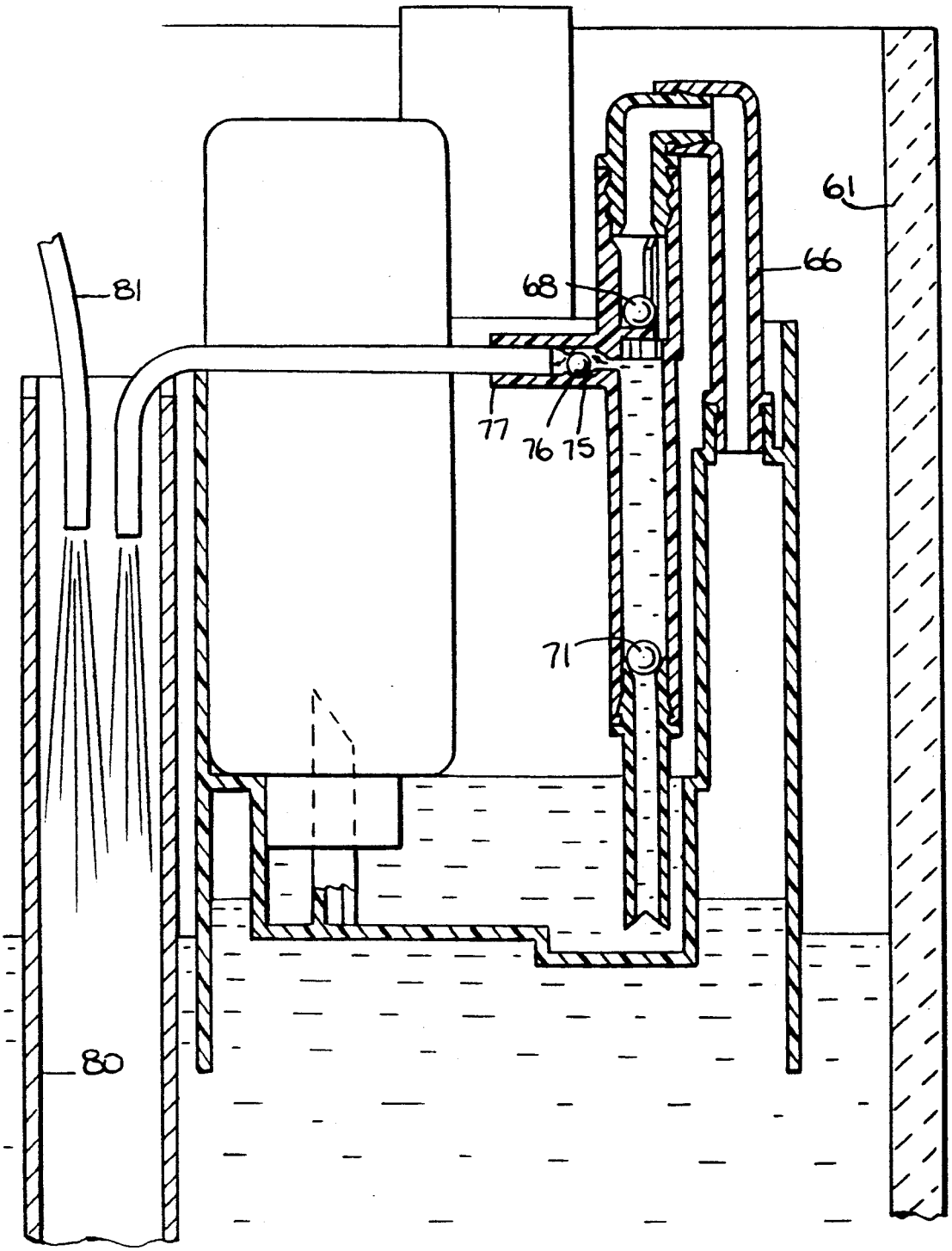
FIG. 8 is a sectional view showing the FIG. 5 dispensing apparatus in the discharge stage during the rise of the water in the toilet tank during the flush cycle.

Referring now to FIG. 8, when the toilet tank fills, the water rises in the toilet tank, compressing the air in the conduit 66, forcing the high-low pressure ball check 68 to open and forcing the product to be discharged from the accumulator 65 through the product discharge means forcing the discharge ball check 76 to be unseated. The accumulator chamber 65 thereby communicates with the product discharge conduit 77 and the additive product is discharged into the toilet tank overflow pipe 80. The product is washed down the overflow pipe in the toilet tank pipe by water from the bowl refill tube 81.

The conduit 66 preferably extends to the top of the apparatus 62 and communicates by way of the check valve seat 67 with the accumulator 65. The discharge conduit 77 serves as a volume control discharge tube. The amount of the product 69 discharged within the accumulator chamber 65 is determined by the height of the discharge conduit 77 within the accumulator chamber 65. Upon total exhaustion of the product between the high/low pressure seat 67 and the volume discharge tube 77, the system reaches equilibrium and returns to the static condition represented in FIG. 5.

Figure 9:
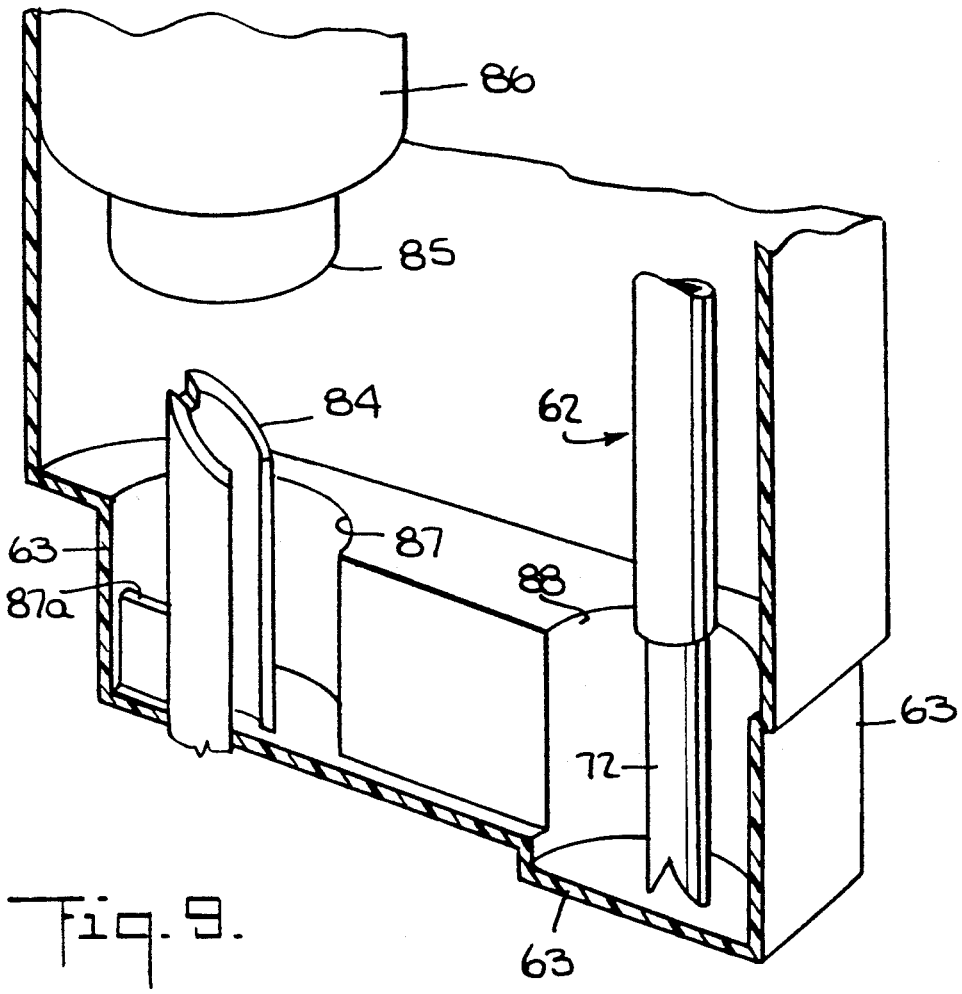
FIG. 9 is a fragmentary sectional view of the FIG. 5 dispensing apparatus.
Figure 10:
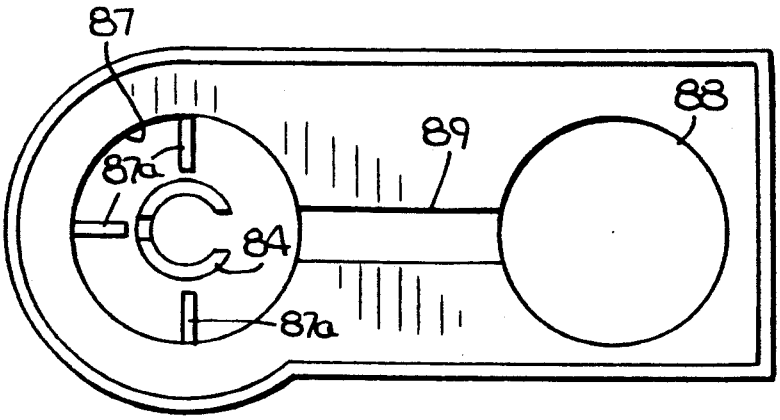
FIG. 10 is a plan view of a portion of the FIG. 9 dispensing apparatus.

Referring now to FIGS. 9 and 10, additive product dispensing apparatus for a toilet tank comprises a product chamber 63 having an upstanding partially open tube 84 for piercing a thin cover 85, for example, a foil cover, of a product container 86 to be placed thereon. The product chamber 63 includes a well 87 having walls 87*a* for maintaining the product container 86 in position. The product chamber includes a well 88 into which a product inductor conduit extends. A channel 89 connects the partially open tube 84 and the well 88 for a liquid product to flow from the product container 86 to the product inductor conduit 72.

The additive product preferably is a combination of ingredients, which when dispensed by a suitable device into the overflow pipe within the toilet tank after each flushing action, is washed by the bowl refill water into the water in the bowl. Through an insolubilization process, the majority of the product floats to the surface of the toilet bowl water forming a very thin film of product or fragrance oil covering the water's surface creating an effective bathroom air freshener or cleaner.

A product composition which satisfies the desired film forming properties comprises a fragrance compound of 0.1%–20%, preferably with a specific gravity of less than 1, a surface active agent, if needed, in quantities of 0–10% (the amount depending on each individual formulation), and an organic chemical which is miscible or soluble with a wide range of polar and nonpolar solvents as well as with water. Examples of these would be glycol, ethyl alcohol or isopropyl alcohol. The level of concentration is dependent on each specific formulation and fragrance, but would generally be in the range of from 0–70%.

The principle involved is as follows: a cleaner or fragrance composition as described contains solvents and surfactants where the ingredients are soluble in both the fragrance oil and water. However, when the product is introduced into large quantities of water such as the toilet bowl, the solvent and surfactants can no longer solubilize the fragrance in the water, causing the majority of the fragrance and the cleaners to split out of solution and float to the surface of the water in the bowl forming a thin film of product forming an effective toilet bowl air freshener or cleaner.

From the foregoing description it will be seen that there is provided a dispensing apparatus which is operative to dispense a metered quantity of chemical solution into a toilet tank overflow pipe and thereby directly into the toilet bowl of water. This action results in eliminating the wasting of excessive chemicals within the toilet tank and provides a dispensing technique allowing for the dispensing of cleaning, disinfecting, deodorizing or fragrancing materials into the toilet bowl of water at an appropriate time toward the end of the flush cycle so that all of the treatment solutions remain in the toilet bowl of water after the flushing cycle. The apparatus of the invention is operative to receive material in solution during the flush cycle and properly injects suitable quantities of solution at the proper time in the flush cycle directly into the toilet bowl water via the overflow standpipe such that the treatment retains its effectiveness in cleansing, disinfecting, deodorizing or fragrancing of the toilet bowl between flushes.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An additive product dispensing apparatus for a toilet tank having a fill valve and an overflow pipe and containing water at a water level comprising:

a product chamber adapted to be positioned within the toilet tank for receiving an additive liquid product therein;

an accumulator chamber having a conduit positioned to communicate with said toilet tank, said conduit being positioned to extend above and below the toilet tank water level;

said accumulator chamber having a first high/low pressure gate controlling communication through said conduit between said accumulator chamber and said toilet tank;

said accumulator chamber also having a second high/low pressure gate;

a product inductor conduit communicating with said product chamber and through said second high/-low pressure gate with said accumulator chamber;

product discharge means, communicating with said accumulator chamber and having a product discharge high/low pressure gate, for controlling product discharge; and a product discharge conduit communicating with said accumulator chamber through said product discharge means and extending toward the toilet tank overflow pipe; whereby, when the toilet tank water level falls during flushing, the water level in said conduit communicating with said toilet tank falls, causing a reduced pressure in said accumulator chamber and thereby causing the closing of said product discharge high/low pressure gate resulting in a drawing of said product in said inductor conduit, causing an opening of said second high/low pressure gate to fill said accumulator chamber thereby closing said first high/low pressure gate, and, when the toilet tank fills, the water rises in the toilet tank, compressing the air in the conduit communicating with the toilet tank, and forcing the product to be discharged from the accumulator chamber through the product discharge means and into the toilet tank overflow pipe.

2. An additive product dispensing apparatus in accordance with claim 1 in which when the toilet tank is emptied during flushing, said three high/low pressure gates are closed.

3. Apparatus in accordance with claim 1, in which said gates are ball valve mechanisms.

4. Apparatus in accordance with claim 1 in which said product chamber includes a recess communicating with said product inductor conduit and has a protrusion displaced from said product inductor conduit for piercing a covered opening of a removable product container.

5. Apparatus in accordance with claim 1 in which said first high/low pressure gate comprises a high/low pressure first ball check of specific gravity less than the specific gravity of the product.

6. Apparatus in accordance with claim 1 in which said second high/low pressure gate comprise a high/-low pressure second ball check of specific gravity greater than the specific gravity of the product.

7. Apparatus in accordance with claim 1 in which said product discharge high/low pressure gate comprises a third ball check which is open in response to product discharge through said product discharge high/low pressure gate when the water rises in the toilet tank as the toilet tank fills.

8. Apparatus in accordance with claim 1 in which the product discharge conduit is a horizontal conduit extending from the accumulator chamber above the height of the toilet tank overflow pipe.

9. An additive product dispensing apparatus for a toilet tank having a fill valve and an overflow pipe and containing water at a water level comprising:

a product chamber adapted to be positioned within the toilet tank for receiving an additive liquid product therein;

an accumulator chamber having a conduit positioned to communicate with the toilet tank said conduit being positioned to extend above and below the toilet tank water level;

the accumulator chamber having a high/low pressure ball seat for receiving a high/low pressure first ball check;

a high/low pressure first ball check of specific gravity less than the specific gravity of the product;

said accumulator chamber having a high/low pressure second ball seat for receiving a high/low pressure second ball check;

a high/low pressure second ball check having a specific gravity greater than the specific gravity of the product;

a product inductor conduit communicating through said high/low pressure second ball seat and check with the accumulator chamber and communicating with the product chamber;

a product discharge conduit communicating with the accumulator chamber and having a discharge ball seat therein for receiving a product discharge ball check;

a product discharge ball check;

said product discharge conduit extending toward the toilet tank overflow pipe.

* * * * *